US007066061B1

(12) United States Patent
Chen et al.

(10) Patent No.: US 7,066,061 B1
(45) Date of Patent: Jun. 27, 2006

(54) SCREWDRIVER HAVING REMOVABLE HIDDEN TIPS

(76) Inventors: Yi Ying Chen, No.82, Lane 59, Shinming, Taiping City, Taichung County (TW); Siou Ru Chen, Floor 16-1, No. 362-20, Sec. 2, Songjhu Rd., Neighbor 1, Songmao Village,Beitun District, Taichung City (TW); Su Fen Lin, No. 138, Section 6, Chongde Rd.,Beitun District, Taichung City (TW)

( * ) Notice: Subject to any disclaimer, the term of this patent is extended or adjusted under 35 U.S.C. 154(b) by 0 days.

(21) Appl. No.: 11/050,220

(22) Filed: Feb. 3, 2005

(51) Int. Cl.
*B25B 23/00* (2006.01)

(52) U.S. Cl. ..... 81/439; 81/177.4; 81/490; 81/440

(58) Field of Classification Search ..... 81/439, 81/440, 177.4, 490, 438
See application file for complete search history.

(56) References Cited

U.S. PATENT DOCUMENTS 6,293,173 B1 * 9/2001 Rowlay ..... 81/490
6,397,709 B1 * 6/2002 Wall ..... 81/440
6,851,339 B1 * 2/2005 Casel ..... 81/177.4

* cited by examiner

*Primary Examiner*—Hadi Shakeri
(74) *Attorney, Agent, or Firm*—Charles E. Baxley

(57) ABSTRACT

A screwdriver includes a main body, an end cap, and a holding seat. Thus, the tips are inserted into the mounting holes of the holding seat and received in the receiving chamber of the main body, thereby facilitating the user carrying the tips, and thereby saving the space of storage. In addition, the holding seat is rotatable relative to the end cap, so that the mounting holes of the holding seat are directed outward to facilitate the user removing or placing the tips.

4 Claims, 4 Drawing Sheets

SCREWDRIVER HAVING REMOVABLE HIDDEN TIPS

BACKGROUND OF THE INVENTION

1. Field of the Invention

The present invention relates to a screwdriver, and more particularly to a screwdriver having removable hidden tips.

2. Description of the Related Art

A conventional screwdriver comprises a main body having a first end formed with a receiving chamber to receive tips of different types and a second end provided with a connecting stem to connect the tips of different types. However, the inner space of the receiving chamber is relatively smaller, so that the receiving chamber cannot be used to receive multiple tips, thereby limiting the versatility of the screwdriver. In addition, all of the tips are received in the receiving chamber, thereby causing inconvenience to a user when taking or placing the tips.

SUMMARY OF THE INVENTION

The present invention is to mitigate and/or obviate the disadvantage of the conventional screwdriver.

The primary objective of the present invention is to provide a screwdriver having removable hidden tips.

Another objective of the present invention is to provide a screwdriver, wherein the tips are inserted into the mounting holes of the holding seat and received in the receiving chamber of the main body, thereby facilitating the user carrying the tips, and thereby saving the space of storage.

A further objective of the present invention is to provide a screwdriver, wherein the holding seat is rotatable relative to the end cap, so that the mounting holes of the holding seat are directed outward to facilitate the user removing or placing the tips.

A further objective of the present invention is to provide a screwdriver, wherein the positioning boss of the holding seat is selectively positioned in either one of the positioning holes of the respective pivot hole of the end cap, so that the holding seat is positioned on the end cap temporarily, thereby facilitating the user removing or placing the tips.

In accordance with the present invention, there is provided a screwdriver, comprising:

a main body having a first end formed with a receiving chamber and a second end provided with a connecting stem;

an end cap mounted on the first end of the main body to close the receiving chamber of the main body;

a holding seat pivotally mounted on the end cap and rotatable relative to the end cap;

at least one positioning mechanism mounted between the holding seat and the end cap to position the holding seat after rotation.

Further benefits and advantages of the present invention will become apparent after a careful reading of the detailed description with appropriate reference to the accompanying drawings.

DETAILED DESCRIPTION OF THE INVENTION

Figure 1:
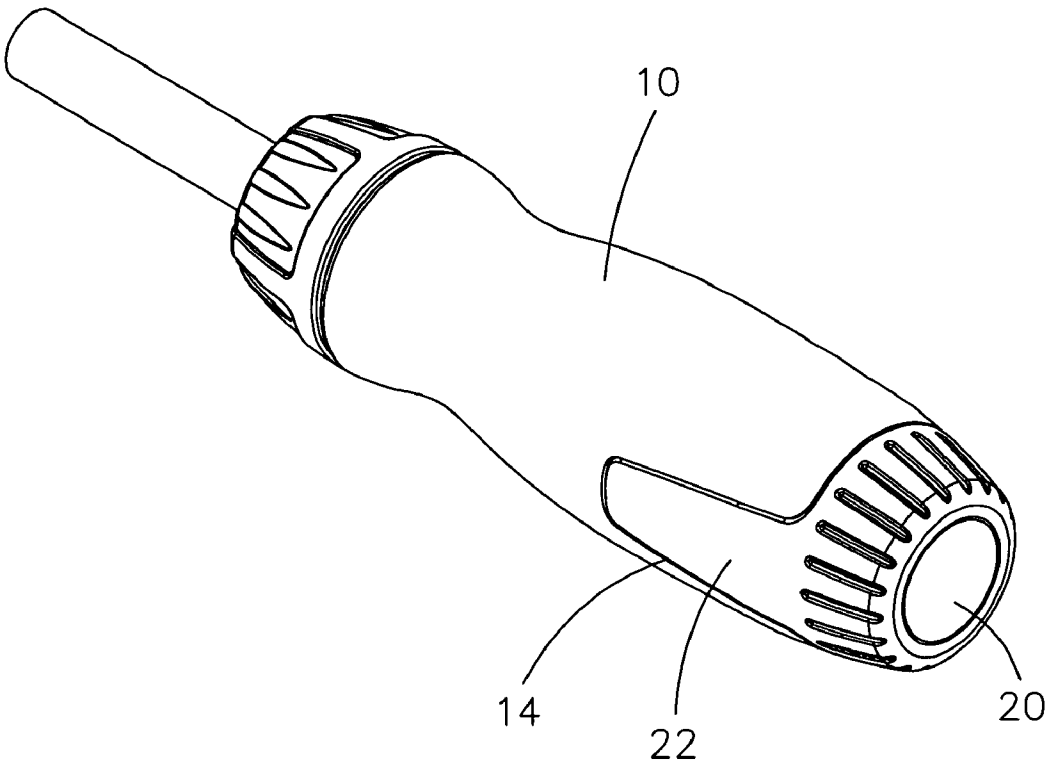
FIG. 1 is a perspective view of a screwdriver in accordance with the preferred embodiment of the present invention.
Figure 2:
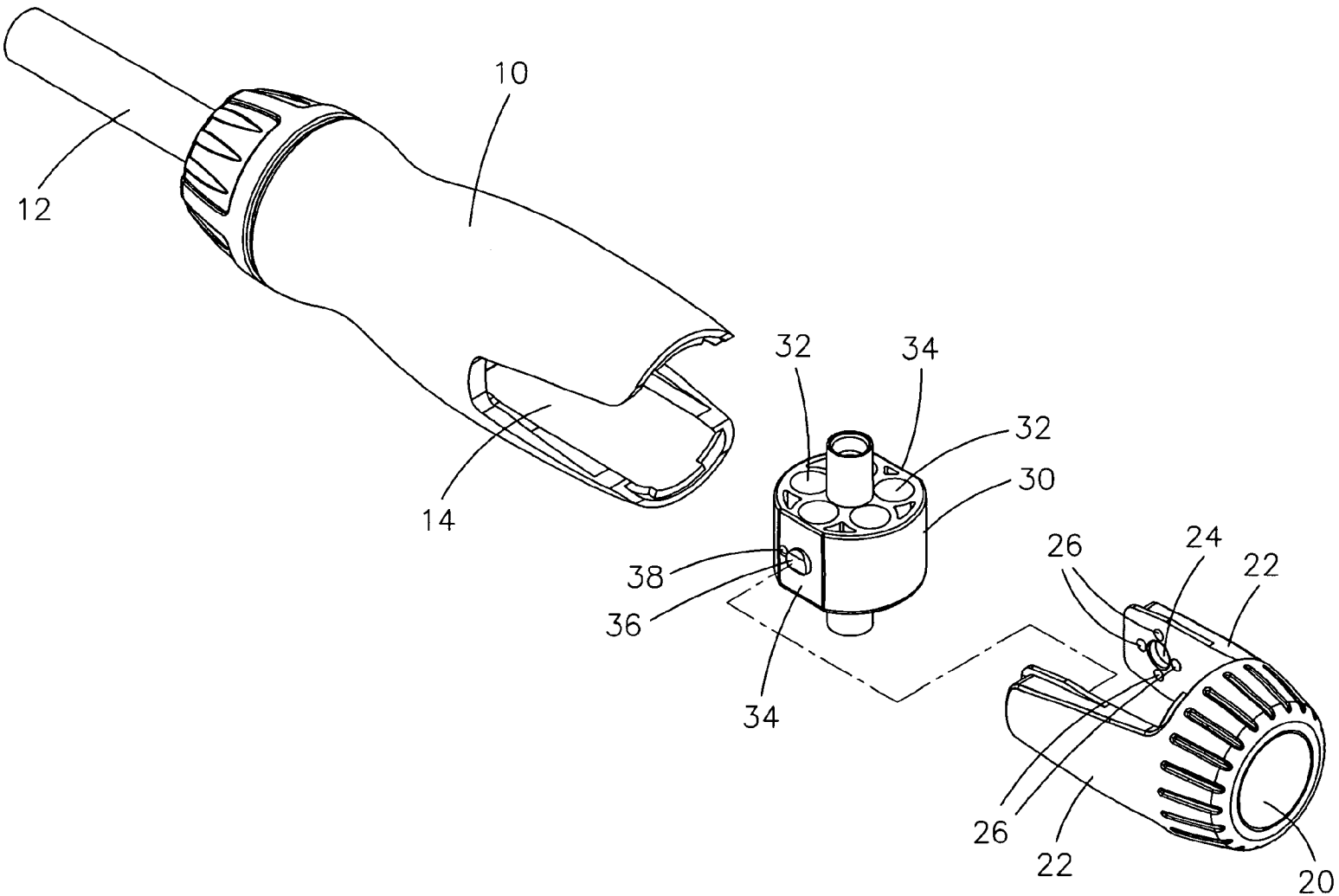
FIG. 2 is an exploded perspective view of the screwdriver as shown in FIG. 1.
Figure 3:
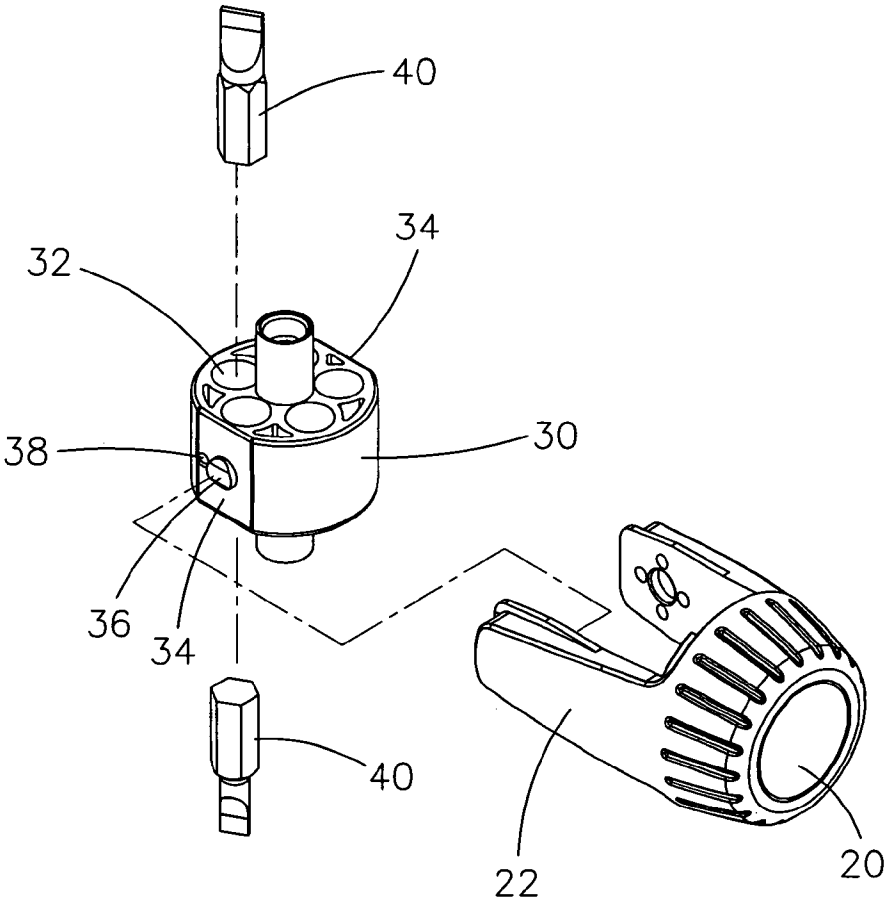
FIG. 3 is a partially exploded perspective view of the screwdriver as shown in FIG. 1.

Referring to the drawings and initially to FIGS. 1–3, a screwdriver in accordance with the preferred embodiment of the present invention comprises a main body 10, an end cap 20, and a holding seat 30.

The main body 10 has a first end formed with a hollow receiving chamber 14 and a second end provided with a connecting stem 12 to connect tips of different types.

The end cap 20 is removably mounted on the first end of the main body 10 to close the receiving chamber 14 of the main body 10 and has two side walls 22 each received in the receiving chamber 14 of the main body 10 and each having a face formed with a pivot hole 24. The pivot hole 24 of at least one of the two side walls 22 of the end cap 20 has a periphery formed with a plurality of positioning holes 26. In the preferred embodiment of the present invention, the pivot hole 24 of each of the two side walls 22 of the end cap 20 has a periphery formed with four positioning holes 26.

The holding seat 30 is pivotally mounted on the end cap 20 and received in the receiving chamber 14 of the main body 10. The holding seat 30 has a plurality of axially extended mounting holes 32 for mounting a plurality of tips 40 and has two opposite sides 34 each provided with a protruding shaft 36 pivotally mounted in the respective pivot hole 24 of the end cap 20 and each provided with a positioning boss 38 selectively positioned in either one of the positioning holes 26 of the respective pivot hole 24 of the end cap 20. Thus, the holding seat 30 is rotatable relative to the end cap 20.

As shown in FIG. 3, the tips 40 are inserted into the mounting holes 32 of the holding seat 30. It is appreciated that the tips 40 can be inserted into the two opposite ends of the same mounting holes 32 of the holding seat 30.

Figure 5:
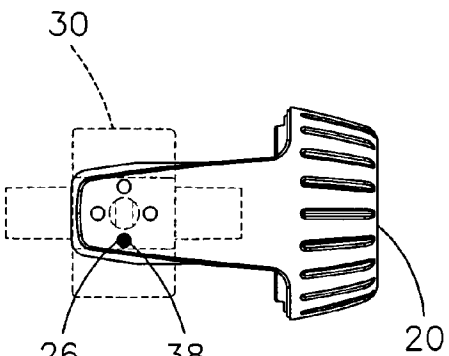
FIG. 5 is a plan view of the screwdriver as shown in FIG. 4.
Figure 4:
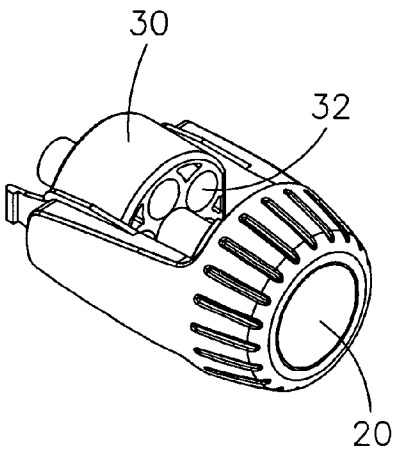
FIG. 4 is a partially perspective view of the screwdriver as shown in FIG. 1.

As shown in FIGS. 4 and 5, after the end cap 20 is removed from the main body 10, the holding seat 30 is rotatable relative to the end cap 20 so that the holding seat 30 is parallel with the end cap 20. At this time, the positioning boss 38 of the holding seat 30 is positioned in either one of the positioning holes 26 of the respective pivot hole 24 of the end cap 20. In addition, the holding seat 30 has an axial direction parallel with that of the end cap 20, so that the mounting holes 32 of the holding seat 30 are directed outward to facilitate a user removing or placing the tips 40.

Figure 7:
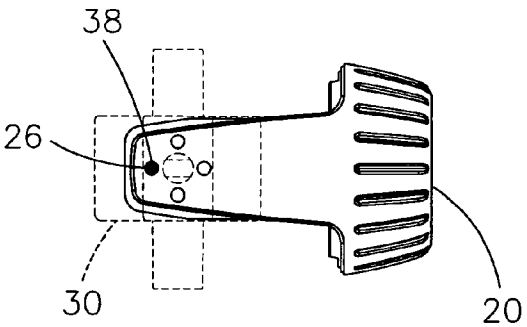
FIG. 7 is a plan view of the screwdriver as shown in FIG. 6.
Figure 6:
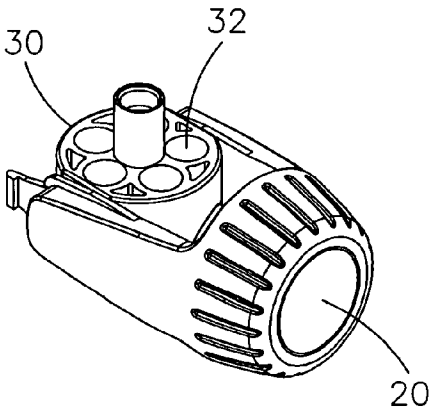
FIG. 6 is a schematic operational view of the screwdriver as shown in FIG. 4.

As shown in FIGS. 6 and 7, the holding seat 30 is rotatable relative to the end cap 20 so that the holding seat 30 is perpendicular to the end cap 20. At this time, the positioning boss 38 of the holding seat 30 is positioned in another one of the positioning holes 26 of the respective pivot hole 24 of the end cap 20. In addition, the holding seat 30 has an axial direction perpendicular to that of the end cap 20, so that the mounting holes 32 of the holding seat 30 are directed outward to facilitate the user removing or placing the tips 40.

Figure 8:
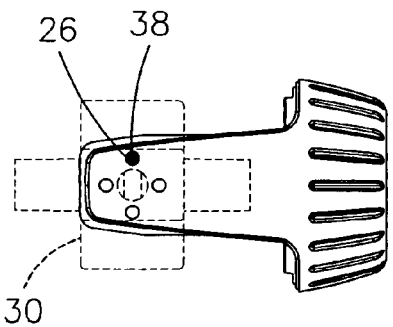
FIG. 8 is a schematic operational view of the screwdriver as shown in FIG. 5.

As shown in FIG. 8, the holding seat 30 is rotatable relative to the end cap 20 so that the positioning boss 38 of the holding seat 30 is positioned in another one of the positioning holes 26 of the respective pivot hole 24 of the end cap 20.

Figure 9:
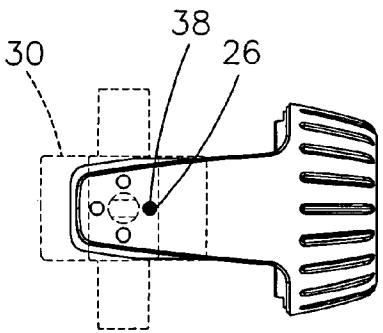
FIG. 9 is a schematic operational view of the screwdriver as shown in FIG. 7.

As shown in FIG. 9, the holding seat 30 is rotatable relative to the end cap 20 so that the positioning boss 38 of the holding seat 30 is positioned in another one of the positioning holes 26 of the respective pivot hole 24 of the end cap 20.

Accordingly, the tips 40 are inserted into the mounting holes 32 of the holding seat 30 and received in the receiving chamber 14 of the main body 10, thereby facilitating the user carrying the tips 40, and thereby saving the space of storage. In addition, the holding seat 30 is rotatable relative to the end cap 20, so that the mounting holes 32 of the holding seat 30 are directed outward to facilitate the user removing or placing the tips 40. Further, the positioning boss 38 of the holding seat 30 is selectively positioned in either one of the positioning holes 26 of the respective pivot hole 24 of the end cap 20, so that the holding seat 30 is positioned on the end cap 20 temporarily, thereby facilitating the user removing or placing the tips 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A screwdriver, comprising:

a main body having a first end formed with a receiving chamber and a second end provided with a connecting stem;

an end cap mounted on the first end of the main body to close the receiving chamber of the main body;

a holding seat pivotally mounted on the end cap and rotatable relative to the end cap;

at least one positioning mechanism mounted between the holding seat and the end cap to position the holding seat after rotations;

wherein the end cap has two side walls each having a face formed with a pivot hole, and the holding seat has a face provided with two opposite shafts each pivotally mounted in the respective pivot hole of the end cap.

2. The screwdriver in accordance with claim 1, wherein the positioning mechanism includes a positioning boss and a plurality of positioning holes.

3. The screwdriver in accordance with claim 2, wherein the positioning boss of the positioning mechanism is mounted on the holding seat.

4. The screwdriver in accordance with claim 2, wherein the positioning holes of the positioning mechanism are formed in the end cap.

* * * * *